United States Patent [19]

Wedler

[11] 4,368,048

[45] Jan. 11, 1983

[54] SHIP S DRIVE SYSTEM

[75] Inventor: Herbert Wedler, Witten, Fed. Rep. of Germany

[73] Assignee: Mannesmann Aktiengesellschaft, Düsseldorf, Fed. Rep. of Germany

[21] Appl. No.: 165,727

[22] Filed: Jul. 3, 1980

[30] Foreign Application Priority Data

Jul. 4, 1979 [DE] Fed. Rep. of Germany ..... 2927386

[51] Int. Cl.[3] ..... F16H 37/06

[52] U.S. Cl. ..... 440/75; 440/3; 440/4; 74/665 GA; 74/15.63; 114/269

[58] Field of Search ..... 440/3, 4, 75; 114/269; 74/665 GA, 15.63, 15.8, 15.82, 15.84

[56] References Cited

U.S. PATENT DOCUMENTS

| | | | |
|---|---|---|---|
| 3,031,893 | 5/1962 | Doleschalek | 74/15.82 |
| 3,643,642 | 2/1972 | Jones | 74/15.63 |
| 3,669,230 | 6/1972 | Burkhardt | 74/15.63 |
| 4,153,002 | 5/1979 | Sigg | 440/3 |
| 4,309,914 | 1/1982 | Hiersig | 440/4 |

FOREIGN PATENT DOCUMENTS

| | | | |
|---|---|---|---|
| 2028747 | 2/1980 | United Kingdom | 440/4 |

*Primary Examiner*—Trygve M. Blix
*Assistant Examiner*—D. W. Keen
*Attorney, Agent, or Firm*—Ralf H. Siegemund

[57] ABSTRACT

A propulsion and drive system for a ship includes an engine, a drive train with transmission gear and main clutch, and a propeller shaft. An auxiliary equipment shaft is connected to that drive train via two branches, geared to the drive on opposite sides from the main clutch; and each branch has its own clutch so that only one branch at a time is effective. The branch on the propeller shaft side from the main clutch is effective during high-speed cruising, the other branch during slow speeds, or even during stopping. The auxiliary equipment is to be run at constant speed throughout. Two different examples are the relative location of parts and the coaxial relation among the three clutches involved.

10 Claims, 2 Drawing Figures

SHIP S DRIVE SYSTEM

BACKGROUND OF THE INVENTION

The present invention relates to a marine propulsion and ship's drive system, having a drive train, including a gear transmission for connecting an engine to a propeller shaft, and further having a branch and auxiliary shaft drivingly connected to that drive train for powering auxiliary equipment.

Marine propulsion and ship drive systems of the type to which the invention pertains include usually an engine with an output shaft; a propeller shaft; and a speed-reducing, clutch-controlled transmission gear system connecting the engine shaft to the propeller shaft. The branch and auxiliary shaft means are connected to that transmission for deriving power from the main engine, e.g., for driving electric generators, hydropumps, compressors, and/or other auxiliary systems and devices.

Depending upon the particulars of a branch, it may be designed as primary branch or secondary branch; the first variety can be driven independently from the propeller, the second variety operates only when the propeller is driven. Moreover, a secondary branch is dependent upon the operating state of the engine. Many modern ships have propellers with adjustable pitch so that the engine can run with a constant speed; different operating conditions and a variety of cruising speeds and conditions of the vessel are accommodated by propeller adjustment. Particularly in the case of a Diesel engine, this type of operation permits optimization of the engine. In general, such optimization, however, requires a lower, constant speed for particular low power operations, such as low speed maneuvering, or the like. Hence, at least two engine speeds are needed in order to cover the entire range of operational speeds of the vessel. On the other hand, some auxiliary equipment, such as generators, require constant input speed throughout (including the case when the ship's propeller has been stopped entirely). Thus, in the case of a secondary power branch system, one needs additional adjustable transmission means to ensure a constant generator speed, independently from the engine speed variations.

DESCRIPTION OF THE INVENTION

It is an object of the present invention to improve the branching of auxiliary power from the driving train and transmission gear in a ship's drive system, bearing in mind that auxiliary power is needed usually at a constant speed, even if the engine and/or propeller shaft speed varies, and considering that the case of zero propeller speed must be included since not only auxiliary power may still be needed, but that power may always require constant input speed.

It is a particular object of the present invention to improve auxiliary power branching in a ship's drive system which includes a transmission gear having a clutch which, so to speak, separates that gear into a propeller side portion and an engine side portion.

In accordance with the preferred embodiment of the present invention, it is suggested to provide a particular two-branch transmission for the auxiliary device and its input shaft; each branch includes a clutch: one is connected to the propeller shaft side portion of the main transmission gear, as per the specific object, whereas the other branch is connected to the other side. The first-mentioned branch is activated during relatively high-speed cruising; it requires an activated main clutch. The second branch is activated for low-speed, low-power, or even zero speed, operation while the engine is still running, at a lower but constant speed.

In one example, the auxiliary shaft is provided with two clutch members coacting respectively with two other clutch members which are sitting on hollow shafts being traversed by the auxiliary shaft. The hollow shafts carry gears, one meshing with a gear on the engine shaft, and one meshing with a pinion that drives also the large gear for the propeller shaft. In another example, auxiliary and engine-driven shaft means each carry a clutch member, the respective coacting members having hollow shafts with gears; one of the gears meshes a gear on the auxiliary shaft, the other one meshes directly the large gear for the propeller shaft. The gearing of the main drive train is included in a housing, but all three clutches are disposed outside that housing in either case. The two examples differ in that, in one case, the two auxiliary branch clutches are coaxial on the auxiliary shaft, and in the other example, only one of these clutches is on that shaft, while the other one is coaxial with the main clutch on the engine-driven shaft.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Proceeding now to the detailed description of the drawings, FIG. 1 illustrates a diesel engine 1 as primary drive and motion power source. The principle purpose of that drive is to drive a propeller shaft 10. The immediate engine shaft is connected to a primary input shaft 3 by means of an elastic coupling 2. Shaft 3 is, in fact, an engine shaft extension, constituting part of an engine-driven shaft means. In particular, shaft 3 is the input shaft of a ship's transmission gearing contained in a housing or case 11. This housing 11 is not shown completely; it is shown open and fragmented near the bottom of the figure in order to indicate that a second primary power input system may be provided for, to drive additionally a large gear 7.

Figure 1:
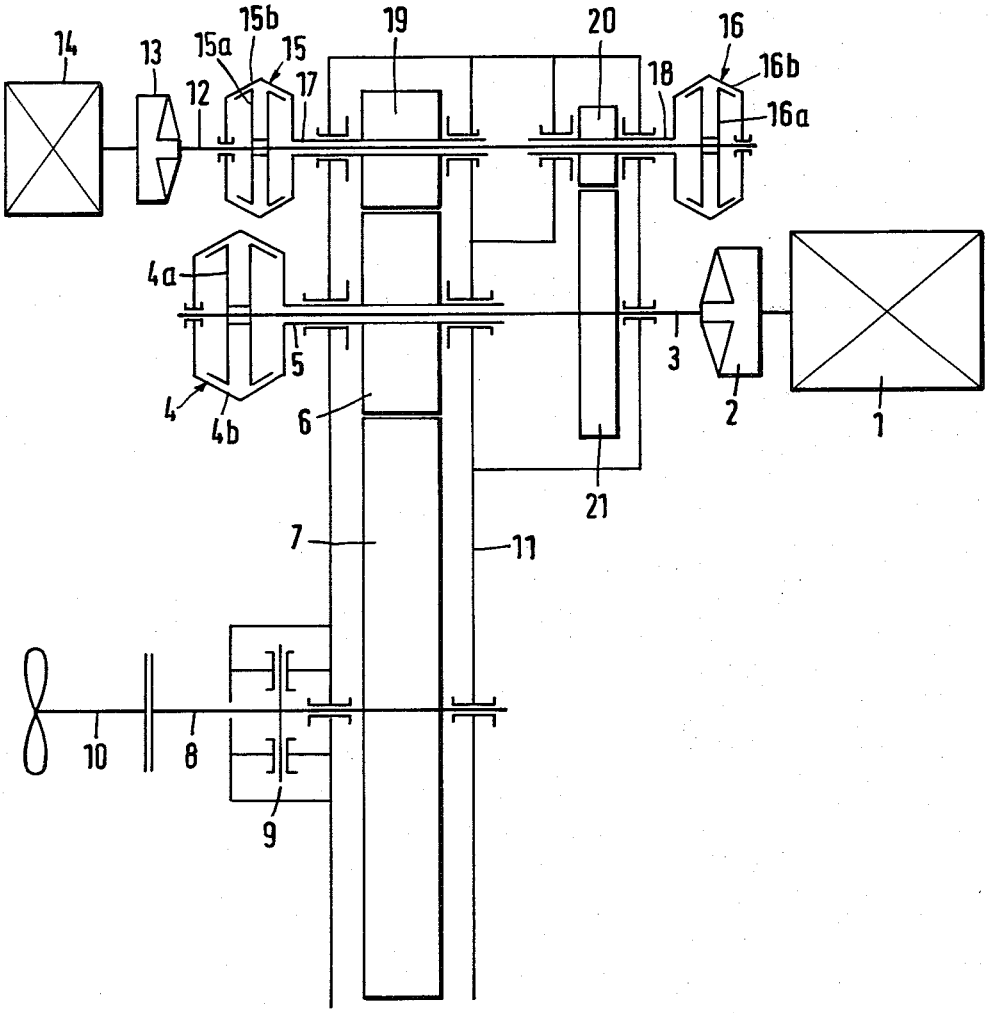
FIG. 1 is a schematic view of a ship's drive system with auxiliary power branching in accordance with the preferred embodiment of the invention.

Shaft 3 traverses housing or case 11, there being suitable bearings, and terminates on the opposite side, outside housing 11, in the primary, input part or member **4*a* of a main clutch 4. The secondary, output part or member 4*b* of that clutch is connected to a hollow shaft 5 which receives and is traversed by shaft 3. Shaft 5 carries a pinion 6 which meshes with the large gear 7 of the ship's transmission. As stated, another pinion, hollow shaft, clutch, engine combination may be provided to impart additional torque upon gear 7**.

The large gear 7 sits on a shaft 8, being supported in thrust bearings 9; and shaft 8 is connected to propeller shaft 10. It can, thus, be seen that a kinematic connection is provided from the engine to the propeller, and includes shafts 3 and 5 as well as shafts 8 and 10; and the connection between shafts 3 and 8 includes particularly clutch 4 (with shaft 5), pinion 6, and large gear 7. One may also say that clutch 4 has an engine side portion including the rotational parts leading to input member 4*a;* and this clutch has a propeller side portion, being the parts of the drive train connected to hollow shaft 5, such as pinion 6, gear 7, and so forth.

Additional transmission means are provided for deriving motive power from this main transmission gear, for particularly driving a piece of auxiliary equipment such as an electric generator 14. This additional transmission has two branches. The first branch includes a gear 21, being provided on shaft 3, and meshing a pinion 20. This pinion 20 sits on a hollow shaft 18, traversing also one wall of case 11 for connection to the secondary part 16*b* of a clutch 16, being the input member in this case. The primary part or member 16*a* of this second clutch is connected to the end of a shaft 12, being part of the auxiliary shaft or shaft means. This shaft 12 traverses housing 11 and ends in an elastic coupling 13 on the other side and outside case or housing 11; generator 14 is connected to that coupling.

In addition, shaft 12 carries the primary part or member 15*a* of a third clutch, 15, whose secondary member or part 15*b* is connected to a hollow shaft 17. These elements are portions of the second branch of the auxiliary transmission that leads to generator 14. Shaft 17 carries a pinion 19 which meshes with pinion 6 and is, thus, geared to the propeller side portion of the main driving train.

In the preferred form of practicing the invention as illustrated, clutches 15 and 16 as well as the main clutch 4 are constructed as double cone friction clutches.

During regular cruising, engine 1 drives the propeller shaft via the elements 2-3-4-5-6-7-8-10, whereby clutch 4 is turned on or activated to interconnect its primary and secondary parts. The rotational speed is relatively high, though being, of course, reduced from the speed of the engine shaft. Also, clutch 15 is energized, but not clutch 16. Thus, a driving connection to generator 14 is provided from pinion 6 to pinion 19, shaft 17, clutch 15, shaft 12, and coupling 13.

Low speeds of the vessel during maneuvering in harbors, passage through channels, and so forth, require the reduction of the engine speed. The propeller shaft is driven as before. However, the state of clutches 15 and 16 is reversed, clutch 15 is off, and clutch 16 is on and activated. Thus, low speed gear 21 is driving high speed pinion 20 and drives also shaft 12 via clutch 16 of the other auxiliary transmission branch for generator 14.

It can readily be seen that this second mode of operating the generator can be used to drive the generator 14 even when the ship has stopped and shaft 10 does not rotate because main clutch 4 is off. As long as the engine does run, a kinematic connection can be established to shaft 12 and maintained via clutch 16.

Figure 2:
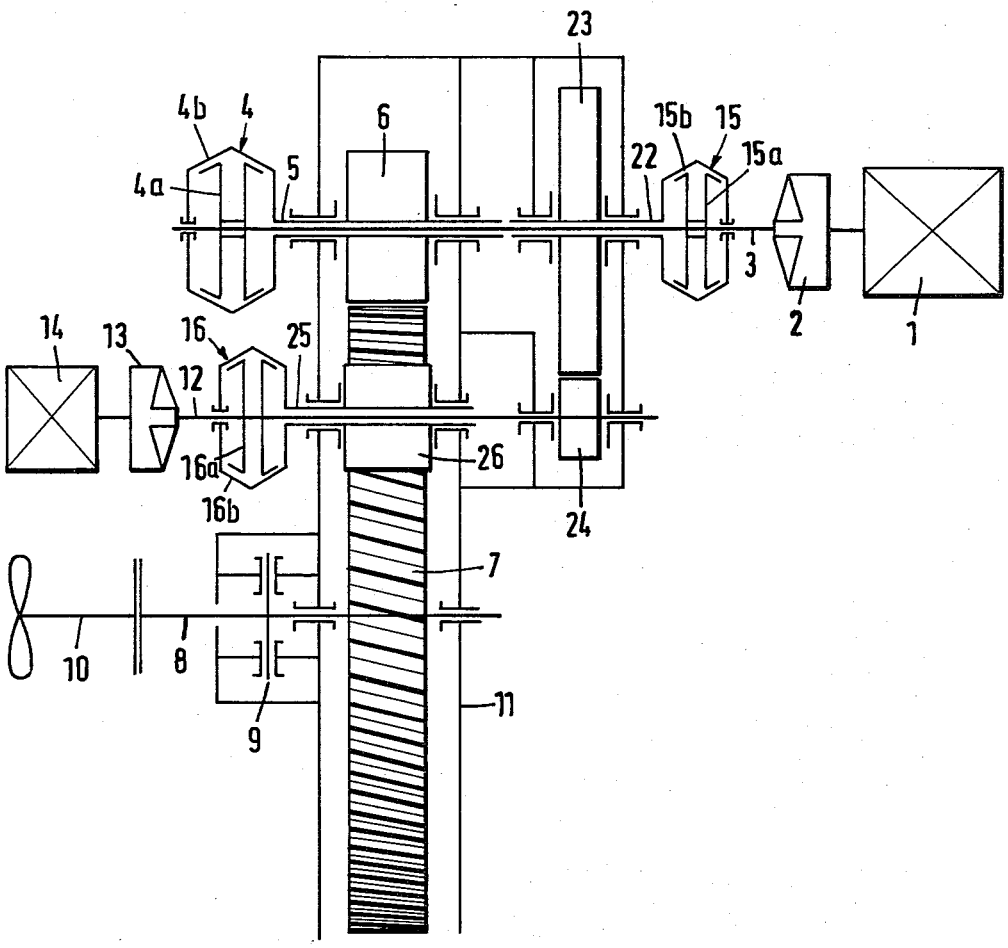
FIG. 2 illustrates another example of that embodiment.

FIG. 2 now illustrates a modified example of a system with double branching. FIG. 1 shows the auxiliary transmission to have its two inputs operate coaxially on auxiliary shaft 12, the two controllable clutches 15 and 16 being disposed coaxially to each other accordingly. Derivation of a rotational output from the propeller shaft side of the main clutch 4 requires an additonal pinion, 19, being, of course, located in the same plane as the main gear 7. Shaft 13 may be located (but does not have to be) in the same plane defined by the axes of shafts 3 and 8. The arrangement of FIG. 2 shows a different arrangement of the clutches and an azimuthal offset of the auxiliary shaft 12. The two examples differ primarily in differences of accommodating the auxiliary transmission branches insofar as their physical location is concerned. These different conditions may be dictated by external circumstances and have, in principle, no bearing on the operation and the mode and manner of tapping the main power and drive train for the purpose of driving auxiliary equipment.

Elements 1 through 10 in FIG. 2 are the same, or very similar in principle to, parts of like designation in FIG. 1; so are several other parts. However, shaft 3 does not carry a gear 21; rather, it carries the primary part 15'*a* of a clutch 15' whose secondary part 15'*b* carries and is connected to a hollow shaft 22, receiving shaft 3. The hollow shaft 22, in this instance, carries a large diameter gear 23 meshing a pinion 24.

It should be observed that the kinematic connection between gears 23 and 24 has been illustrated in a simplified fashion. The auxiliary shaft 12*a* of pinion 24 is not located in the same plane as defined by the axes of shafts 3 and 8. Rather, shaft 12' is azimuthally offset for reasons briefly mentioned above. Shaft 12' is again connected to the generator 14 via elastic coupling 13; and this shaft is also connected to a primary part or member 16'*a* of a clutch 16' whose secondary part or member 16'*b* is connected to hollow shaft 25, being traversed by shaft 12'. A pinion 26 sits on shaft 25. This pinion now meshes also large gear 7 to derive power from that gear. Pinion gear 26 is, of course, azimuthally offset from pinion 6, being part of the main drive train. Broadly speaking, one can also say that in both examples power is derived from one or the other of the two principal shaft drive gears 6 and 7.

If clutch 15' is energized, low speed rotation of shaft 3 is imparted upon gear 23; and pinion 24 drives shaft 12' and generator 14 at a stepped-up speed. Again, this mode of operation is possible for energized or deenergized clutch 4, i.e., for slow speed, or even a stopped propeller shaft. Clutch 16' is off in either case.

If clutch 16' is energized but clutch 15' is off, pinion 26, being driven by main gear 7, will drive shaft 12' via clutch 16' and the generator will be driven at the requisite speed.

It can readily be seen that in both examples, an additional engine can be provided, another main clutch and another pinion, similar to pinion 6, and also meshing main gear 7. Another auxiliary shaft and transmission arrangement may be provided also here in order to drive another piece of auxiliary equipment.

The invention is not limited to the embodiments described above; but all changes and modifications thereof, not constituting departures from the spirit and scope of the invention, are intended to be included.

I claim:

1. A ship's drive system which includes propeller shaft means and an engine-driven shaft means, further including an auxiliary shaft means drivingly connected to an auxiliary device, further comprising in combination:

a main clutch, having an input part and an output part;

means (a) for drivingly connecting the output part to the propeller shaft means;

means (b) for drivingly connecting the input part to the engine-driven shaft means 3, so that the propeller can be driven for an activated main clutch;

means (c) including a first clutch 16 for drivingly connecting the means (b) to the auxiliary shaft, so that the auxiliary shaft means can be driven by the engine for the energized first clutch, but independently from the energization of the main clutch;

means (d) including a second clutch 15 for drivingly connecting the means (a) to the auxiliary shaft, so that the auxiliary shaft can be driven by the engine for energized main and second clutches, the driving connection between the engine-driven shaft means and the propeller does not include a driving connection state by the second clutch, the first and second clutch operating mutually exclusively; and the means (b) includes at least one gear, and the means (d) includes a gear meshing the one gear, the means (c) and the means (d) providing different rotational speeds to said auxiliary shaft means for a similar engine speed.

2. A ship's drive system as in claim 1, wherein the first and second clutch each has first parts connected to the auxiliary shaft and second parts with hollow shafts traversed by the auxiliary shaft;

first and second gears respectively on the hollow shafts and respectively included in the means (c) and means (d);

the means (d) further including a pinion meshing the second gear, the means (c) further including a pinion meshing a pinion being included in the means (a).

3. A ship's drive system as in claim 1, wherein the first clutch has a first part on the auxiliary shaft and a second part connected to a hollow shaft with a pinion, the hollow shaft being traversed by the auxiliary shaft, said pinion meshing a large gear included in the means (a) and wherein the second clutch has a first part in said engine-driven shaft means and a second part with a hollow shaft and a gear, the latter hollow shaft being traversed by the input shaft means, there being a pinion on the auxiliary shaft meshing the latter gear.

4. A ship's drive system for driving a propeller by means of an engine and which includes gear transmission means for coupling the engine to the propeller, the transmission means constituting a driving train which includes a main clutch whose input side is drivingly connected to the engine and whose output side is drivingly connected to the propeller, a device for deriving power from the driving train, comprising:

an auxiliary device with input shaft means;

first means drivingly connected to the driving train on the input side of the main clutch and including first clutch means for selective connection to said input shaft means; and second means drivingly connected to the driving train on the output side of the main clutch and including second clutch means for selected connection to said input shaft, the driving connection by the main clutch between the engine and the propeller being independent from connect-disconnect states of the first and second clutch means, the first and second clutch means operating mutually exclusively.

5. A ship's drive system as in claim 4, wherein the first means includes relatively high ratio, step-up gearing and the second means includes relatively low ratio, step-up gearing.

6. A system as in claim 4, the gear transmission means being disposed in a housing, the main clutch and the first and second clutches being disposed outside the housing.

7. A ship's drive system which includes an engine, first means for drivingly connecting the engine to the input side of a main clutch, second means for drivingly connecting the output side of the clutch to a propeller shaft, the second means including a large output gear, the improvement comprising:

an auxiliary shaft connected to a piece of auxiliary equipment;

a first transmission branch including a first clutch and a relatively large gear, and being connected to the first means for being driven therefrom, and further being drivingly connected to said auxiliary shaft; and a second transmission branch including a second clutch and pinion means geared to the second means in the plane of the said large output gear, the second branch being further connected to the auxiliary shaft, the driving connection by the main clutch between the engine and the propeller being independent from connect-disconnect states of the first and second clutch means, the first and second clutch means operating mutually exclusively.

8. A ship's drive system which includes an engine with engine shaft means and a propeller shaft means, the engine shaft means being drivingly connected to a main clutch, the main clutch being further drivingly connected to the propeller shaft means, the connection including a pair of main gears, one being a pinion and the other one having a large diameter meshing with and being driven by the pinion, an auxiliary shaft connected to a piece of auxiliary equipment, the improvement comprising:

a first pinion meshing one of said main gears;

first clutch means for drivingly connecting the first pinion to said auxiliary shaft;

a pair of different diameter intermeshing gears;

a second clutch means having one part connected to one of the gears of the pair, another part of the second clutch means, cooperating with the one part, being connected to one of the auxiliary shafts and the engine shaft; and the other gear of the pair being connected to the other one of the auxiliary shaft and the engine shaft, to establish a transmission branch and driving connection between the engine shaft means and the auxiliary shaft when the second clutch means is activated.

9. System as in claim 8, wherein the other part of the second clutch is connected to the auxiliary shaft, the other gear of the pair sits on the engine shaft means, the pinion meshes the pinion with the main gear.

10. System as in claim 8, wherein the other part of the second clutch is connected to the engine shaft means, the other gear of the pair sits on the auxiliary shaft, the pinion meshes the large main gear.

* * * * *